United States Patent [19]

Truitt

[11] 3,953,659

[45] Apr. 27, 1976

[54] THERMAL PAPER COATING

[75] Inventor: James K. Truitt, Dallas, Tex.

[73] Assignee: Texas Instruments Incorporated, Dallas, Tex.

[22] Filed: July 15, 1974

[21] Appl. No.: 488,340

[52] U.S. Cl. ..... 428/511; 427/148; 428/913

[51] Int. Cl.[2] ..... B41M 5/18

[58] Field of Search ..... 117/36.8, 36.3; 106/26, 106/27; 427/148; 428/511, 913

[56] References Cited

UNITED STATES PATENTS

| | | | |
|---|---|---|---|
| 3,108,896 | 10/1963 | Owen | 117/36.8 |
| 3,416,942 | 12/1968 | Schutzner et al. | 117/36.3 |
| 3,442,682 | 5/1969 | Fukawa | 117/36.8 |

*Primary Examiner*—Thomas J. Herbert, Jr.
*Attorney, Agent, or Firm*—Harold Levine; James T. Comfort; Gary C. Honeycutt

[57] ABSTRACT

A composition useful for coating onto paper to produce a thermal print paper is disclosed. The composition utilizes iron soap and phenolic components as part of the mechanism of print formation with cellulose acetate acting as a binder for the composition. The addition of water to an acetone solution of the composition yields a light-stable coating with an exceptionally white appearance.

6 Claims, No Drawings

THERMAL PAPER COATING

This invention relates to thermally sensitive papers and in particular to compositions useful for producing thermally sensitive layers on paper sheets. The compositions of this invention provide an exceptionally white and light stable coated paper surface.

Development of heat sensitive papers has led to widespread use thereof in recording devices and printers wherein a heated member is placed in direct contact with the paper. While the thermally sensitive papers of this invention are particularly adapted for use in this environment, the thermally sensitive coatings are equally useful when the paper is to be exposed to a radiant heat source.

Previously, heat sensitive sheet materials were specifically designed as copy paper. Such papers, when placed in contact with the surface of an original and the original strongly and briefly irradiated, the heat is selectively absorbed by areas of the original to form a graphic image on the copy sheet. The absorbed radiation is converted to heat energy in a pattern corresponding to the graphic subject matter and the heat flow into the sensitive layer to convert the corresponding areas thereof to a visibly distinct form. In other systems, print heads having dot matrices thereon which are selectively energized to heat the same can be employed for direct printing rather than copying.

Heat sensitive sheets have previously been known in which an opaque blushed lacquer coating is selectively transparentized by heat or other means to expose an undercoating and thereby produce visible changes. The effect has been accomplished by compaction of a soft coherent blush coating, or by the fusion of a blushed lacquer or by the fusion of waxy or other fusible particles within blushed coatings of nonfusing binders. In general, the preparation of blushed lacquer coatings is well known and as usually practiced involves applying a thin top coating of film-forming organic polymer from a solution of a mixture of a voltile liquid solvent and a less readily voltile liquid in which is a nonsolvent for the polymer followed by drying to make the polymer insoluble.

The compositions of this invention provide a single-layer coating for a paper sheet which includes certain advantages of prior blush coatings, but without the necessity of a separate cover layer.

"Blush" as used herein refers to the relative amount of masking of the color of the other components of the formulation. Thus, a coating with greater blush will be whiter than a coating with less blush.

The compositions of this invention include reactive components which form the heat sensitive color-forming mechanism. Additionally, a binder must be present to enable the composition to adhere to the surface of the base sheet to thereby form a thin coating.

The components are usually dissolved or dispersed in a voltile solvent for ease of application to the base sheet.

After the composition is applied to the base sheet, the sheet is gently dried. This is most conveniently done by warming gently in an oven and by providing a generous flow of air. The coating thus formed will tend to be somewhat uneven on a microscopic scale, having a large number of voids and air bubbles contained therein.

The heat sensitive components of the formulation are frequently also quite sensitive to light energy. Thus, if left exposed to light in a typical in-use environment, the paper may gradually darken.

It has been found that an additive which serves to "blush" the coating will impart an increased opacity to the layer and thereby protect the reactive components from premature color formation.

The additive must be a non-solvent for the binder being used. In the prior art various binders for coatings are known. These are generally dissolved in an appropriate solvent. These binders may be "blushed" by the addition of an appropriate non-solvent. For example, cellulose acetate may be blushed with water; nitrocellulose may be blushed with toluene, etc.

While the exact mechanism for the formation of the blush is not known, it is believed to depend on a desolubilization of the binder during the drying process. The amounts of solvent and non-solvent are selected so that the three component system approximates the solubility limit of the binder. As drying takes place, at some point desolubilization takes place. The effect is to produce an opaque rather than the usual clear film.

The blush technique of this invention may be utilized with a wide range of color-producing formulations. For example, U.S. Pat. Nos. 3,108,896 and 3,442,682 each disclose a variety of color-producing formulations, each of which may be utilized with the blush technique.

A typical formulation useful in making a coating for a thermal print paper includes an acetone solution of cellulose acetate as the binder. Various iron soap formulations are included as the color-producing mechanism. The term "iron soaps" means normally solid iron salts of fatty acids. Generally, diphenolic compounds are also included in the compositions. These are compounds having a plurality of hydroxyl groups bonded to a benzene nucleus. Such print papers tend to be lightly colored rather than pure white. This is due to the presence of the iron soaps, which, being colored compounds impart a generally beige color to the coating. This coloration can be masked with other colors, but such masking does not improve the brightness.

In addition, the iron soap compounds are sensitive to light and copy papers coated with formulations including iron soaps tend to darken slowly upon exposure to light.

It has been found that the inclusion of water in the above formulations will blush the cellulose acetate and produce a coating of exceptional whiteness. The inclusion of water in these formulations thus serves to provide opaque coatings and thereby protect the sensitive iron soap compounds, reducing their tendency to darken upon exposure to light.

It is thus an object of this invention to provide a thermal print paper which has exceptional whiteness and which yields a high contrast copy. It is a further object to provide a print paper which has improved light stability. Further objects will become apparent from the following detailed disclosure.

The following formulation is a typical embodiment of the invention. It is to be understood that this is illustrative only and not to be considered as limiting the scope of the invention. The invention includes generally the blushing with water of other formulations which are based on a cellulose acetate binder, as well as blushing other binders contained in appropriate solvents.

EXAMPLE

The following example is based upon the heat induced reaction of an iron soap with a phenolic compound to produce the colored areas.

Three solutions, designated for convenience as Solution A, Solution B and Solution C are prepared in accordance with the following formulations:

| | | |
|---|---|---|
| Solution A | | |
| Ferric stearate | 87 | grams |
| d-tartaric acid | 2 | grams |
| Cellulose acetate | 83 | grams |
| Acetone | 628 | grams |
| | 800 | grams |
| Solution B | | |
| 2,4,5 trihydroxybutyrophenone | 20.5 | grams |
| d-tartaric acid | 2 | grams |
| Stearic acid | 10 | grams |
| Cellulose acetate | 50 | grams |
| Acetone | 718 | grams |
| | 800.5 | grams |
| Solution C | | |
| Equal parts acetone and water | | |

It is to be understood that Solutions A, B and C are prepared separately and should not be mixed until ready for use.

The iron stearate utilized in Solution A should be of a fine particle size since it is not a soluble type of material and requires a small physical configuration in order to form a relatively stable suspension. The iron stearate is suitably pulverized by ball milling iron stearate powder, as is generally commercially available to further break it down to micron size particles. Solution A, when prepared with the finely divided iron stearate, is relatively stable, although it may need shaking after standing for a substantial period of time in order to thoroughly redisperse the ferric stearate.

Prior to this invention, only Solutions A and Solution B would be used. Generally, however, these two solutions would contain some additional acetone compared to the specified formulation. This would be to obtain the proper consistency for application onto the base sheet.

The formulation of a thermally sensitive print paper is accomplished by depositing the coating formulation onto a paper stock. Prior to utilization, Solution A and Solution B would be mixed in equal weights and then applied to the paper. Generally about 7 to 10 pounds of the mixture are required to cover 1,000 square feet of the paper. In some instances, varying thicknesses of layers will be desirable. A typical coating thickness, when on a wet basis, is about 3 to 6 mils, but when dried, the thickness is typically on the order of 5 to 10 mils.

The application to the paper of the mixture is accomplished by means well known in the art, for example, the utilization of a Mayer bar machine or the utilization of a reverse roll coating technique. The coated paper is then dried by conventional techniques.

It is a feature of this invention to incorporate Solution C into the mixture of Solution A and Solution B heretobefore described. Solution C is admixed at about the same time that Solution A and Solution B are combined. The order of mixing is not critical.

It has been found that a useful coating is obtained if from about 300 to about 800 grams of Solution C is incorporated into the total weight of Solutions A and B, and preferably from about 500 grams to about 700 grams of Solution C.

Generally, the water need not be admixed into the composition as an equal parts mixture with the solvent. It can even be added as pure water. However, the addition of pure water will tend to precipitate the cellulose acetate, which must be redissolved prior to use. The dilution of the water with the acetone, or other solvent being used in the particular formulation will eliminate this "shock".

Generally, the greater the relative quantity of water utilized, the greater will be the amount of blush. If too small a quantity of water is incorporated into the formulation, the resultant blush will be relatively low, and the light stability will be severely diminished.

If too much water is introduced into the formulation, the strength of the coating will be decreased. Additionally, the coating will not adhere to the base paper sheet as reliably as when a smaller quantity of water is used. If a large excess of water is used, the coating may adhere so poorly that it can be rubbed off with the fingers.

The quantity of water utilized will also depend slightly upon the drying conditions, such as temperature, humidity and air velocity in the dryer. It is a matter of routine experiment to ascertain such slight variations in optimum amount of water.

While the choice of base paper sheet is not critical, it is preferable that it have a relatively porous surface. In this case, some of the formulation will absorb into the paper, thereby improving the adhesion between the paper and the coating and allowing a greater degree of blush to be used. When the thermal print paper is to be used in an environment of direct contact with a heated print head, it is preferable that the base paper sheet be as smooth as possible to enable the print head to make uniform contact with the coated print paper.

When using prior art thermal print coatings, it has been necessary to utilize a base paper stock which is itself opaque in order to get sufficient contrast between the copy and non-copy areas in the printed sheet. The increased opacity of the coatings of this invention allows the use of translucent or semi-transparent base paper sheets. As this paper is generally less expensive than opaque paper, a significant economic advantage may result from using these coating compositions.

A further benefit accruing from the use of these compositions is that the surface layer of the print paper is less abrasive than usual print papers. Prior formulations have incorporated such materials as $TiO_2$, $SiO_2$ or clay to increase the opacity of the coating. The incorporation of these materials into the coating produces an abrasive print sheet. None of these materials is needed in the present compositions.

The following comparative test was performed by applying compositions with and without the water to a base paper sheet.

1. A first sheet was coated with a mixture of Solution A, Solution B and Solution C. Six hundred (600) grams of Solution C were used.
2. A second sheet was coated with the standard formulation, which was a mixture of Solutions A and B only plus 600 grams of acetone.

Both sheets were coated with sufficient material to produce a coating of 1.5 pounds of dry coating per 100 square feet of paper.

Each sheet was dried. A first sample of each was not exposed to light. A second sample of each was exposed to intense incandescent light for four hours. A third sample of each sheet was exposed to fluorescent light for nine days.

The whiteness of each sample was then measured on a densitometer, wherein a whiter sheet is represented by a lower reading. For reference purposes, a typical bond typing paper has a reflection densitometer reading of 0.0 to 0.08.

| | Sheet 1 | Sheet 2 | Improvement Due to Blush |
|---|---|---|---|
| Unexposed | 0.14 | 0.19 | .05 |
| Exposed | 0.21 | 0.30 | .09 |
| Fluorescent Exposed | 0.22 | 0.34 | .12 |

Having described the invention in connection with certain specific embodiments thereof, it will be understood that further modifications may now suggest themselves to those skilled in the art and it is intended to cover such modifications as fall with the scope of the appended claims.

What is claimed is:

1. A heat-sensitive print sheet comprising a thin flexible sheet material and including a visibly heat sensitive layer comprising:

a. a heat sensitive color producing formulation including a normally solid iron salt of a fatty acid and a diphenolic compound;

b. a binder comprising cellulose acetate;

c. acetone as a solvent for the binder; and d. water as a non-solvent blush material for the binder, wherein said acetone is present in the range of about 1000 through about 1500 parts, and the water is present in the range of about 100 to about 300 parts, per 100 parts cellulose acetate.

2. A heat-sensitive print sheet according to claim 1 wherein the flexible heat material is paper.

3. A heat-sensitive print sheet according to claim 2 wherein the paper is translucent.

4. A process for the production of a heat-sensitive print sheet comprising:

a. forming a first mixture including a normally solid iron salt of a fatty acid, in acetone;

b. forming a second mixture including a diphenolic compound, in acetone, wherein a cellulose acetate binder is dissolved in at least one of said first and second mixtures;

c. forming a third mixture including acetone and water, wherein said acetone is present in the range from about 1000 to about 1500 parts, and the water is present in the range from about 100 to about 300 parts, per 100 parts of cellulose acetate;

d. mixing said first, second and third mixtures to form a fourth mixture;

e. coating said fourth mixture onto a flexible sheet material which is insoluble in acetone; and f. drying the coated flexible sheet material.

5. A process according to claim 4 wherein the flexible sheet material is paper.

6. A process according to claim 5 wherein the paper is translucent.

* * * * *